US007681850B2

(12) United States Patent
Johnson

(10) Patent No.: US 7,681,850 B2
(45) Date of Patent: Mar. 23, 2010

(54) TREE LADDER STAND TRAY

(76) Inventor: David Lawrence Johnson, 1229 Harristown Rd., Ashland City, TN (US) 37015

( * ) Notice: Subject to any disclaimer, the term of this patent is extended or adjusted under 35 U.S.C. 154(b) by 259 days.

(21) Appl. No.: 11/758,800

(22) Filed: Jun. 6, 2007

(65) Prior Publication Data

US 2008/0302931 A1 Dec. 11, 2008

(51) Int. Cl.
*E06C 7/14* (2006.01)
*A47B 96/06* (2006.01)
*E04G 1/00* (2006.01)

(52) U.S. Cl. ..... 248/210; 248/205.1; 182/116; 182/129

(58) Field of Classification Search ..... 248/210, 248/205.1; 182/116, 187, 129, 178.1, 136
See application file for complete search history.

(56) References Cited

U.S. PATENT DOCUMENTS 5,538,101 A 7/1996 Kempf
6,131,699 A 10/2000 Leak, Jr.
6,341,666 B1 * 1/2002 Allen ..... 182/129
7,021,423 B1 4/2006 Pestrue et al.
2004/0216953 A1 * 11/2004 Cheeks ..... 182/116
2007/0089931 A1 * 4/2007 Hunt ..... 182/129

* cited by examiner

*Primary Examiner*—J. Allen Shriver, II
*Assistant Examiner*—Christopher Garft
(74) *Attorney, Agent, or Firm*—James Addison Barry, Jr.

(57) ABSTRACT

A tree ladder stand tray 10 including a tray area 100 and tray supports 110, 120, 130, 140 on each of four sides with a bottom tray 150 attached to the four tray supports within the area formed by the tray supports, such that the supports form an edge to help prevent articles from falling off the tray area; and a bracket 160 including a forward and rear brace 170, 180 attached to the tray area such that the distance between the forward brace and the rear brace is such that the bracket will fit under a tree ladder stand 102 and the tree ladder stand tray may be attached with the tree ladder stand. The tree ladder stand tray may include a second tray area 200 with the tray areas on each side of the tree ladder stand. The tree ladder stand tray may be in combination with a tree ladder stand.

9 Claims, 5 Drawing Sheets

TREE LADDER STAND TRAY

FIELD OF INVENTION

The present invention relates to a device that may be used by hunters and others interested in using tree ladder stands for hunting.

BACKGROUND OF INVENTION

Many outdoor recreational activities require an individual to perch himself well above the ground. In deer hunting, for example, trees frequently provide the best means available to a hunter for avoiding early detection by his prey. Many hunters, photographers, videographers, and other outdoor sports persons use a device commonly known as a tree ladder stand. The typical tree ladder stand is for a hunter or naturalist to position himself above the ground cover for maximum concealment and optimal visibility. However, there is a need for a tree ladder stand with a tray to allow for convenient storage of various items and equipment.

SUMMARY

A tree ladder stand tray including a tray area and tray supports on each of four sides with a bottom tray attached to the four tray supports within the area formed by the tray supports, such that the supports form an edge to help prevent articles from falling off the tray area; and a bracket including a forward and rear brace attached to the tray area such that the distance between the forward brace and the rear brace is such that the bracket will fit under a tree ladder stand and the tree ladder stand tray may be attached with the tree ladder stand. The tree ladder stand tray may include a second tray area with the tray areas on each side of the tree ladder stand. The tree ladder stand tray may be in combination with a tree ladder stand.

BRIEF DESCRIPTION OF THE DRAWINGS

The features, aspects, and advantages of the invention will become better understood with regard to the following description, appended claims, and accompanying drawings where:

DETAILED DESCRIPTION OF THE INVENTION

The present invention relates to the field of trays for tree ladder stands and more specifically this invention provides a tree ladder stand tray that will fit beneath a typical tree ladder stand seat to allow for convenient storage of various items and equipment. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein. For the purposes of this invention, the term tubing may also include and refer to solid material. The tubing term is useful here in the traditional sense of hollow materials but also expanded to include other solid materials especially with composite or plastic materials.

Figure 1:
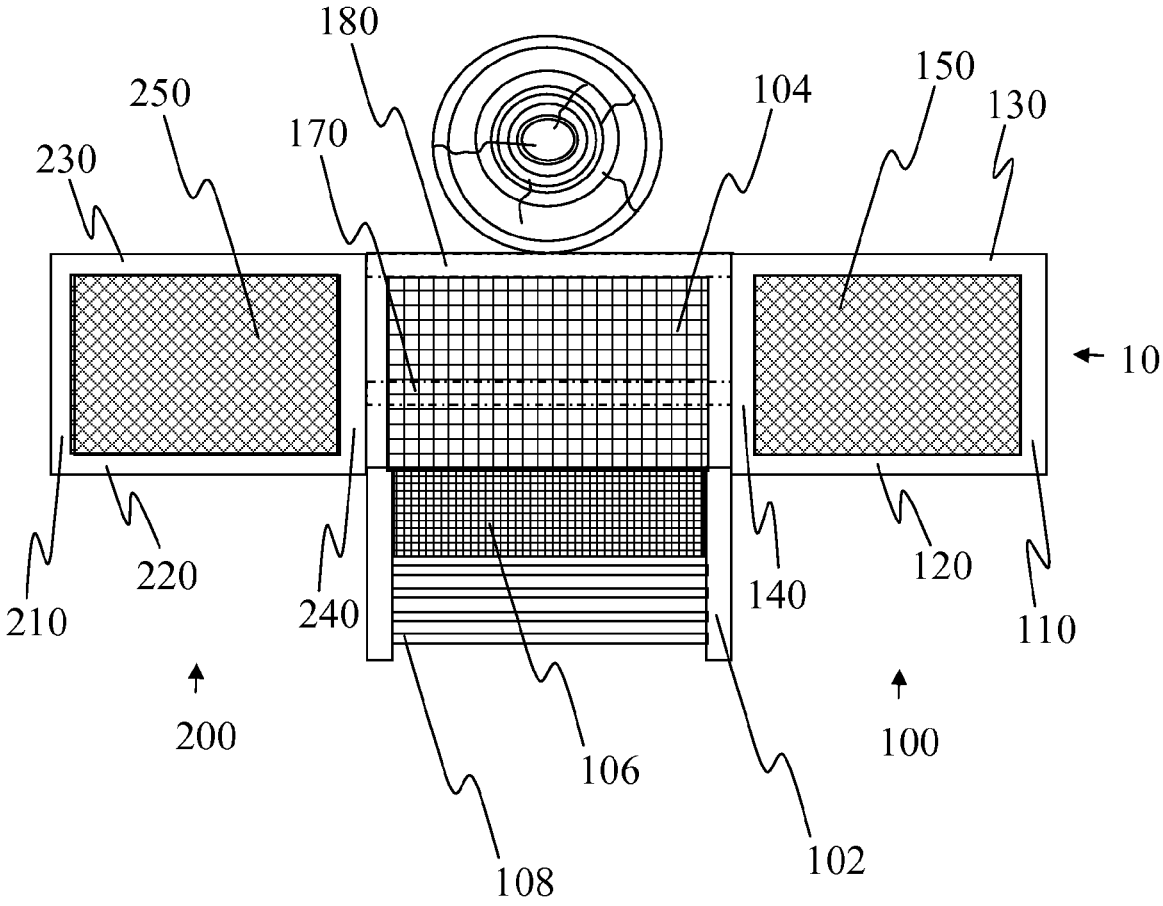
FIG. 1 is a top view of one embodiment of a tree ladder stand tray combined with a tree ladder stand according to the present invention.
Figure 3:
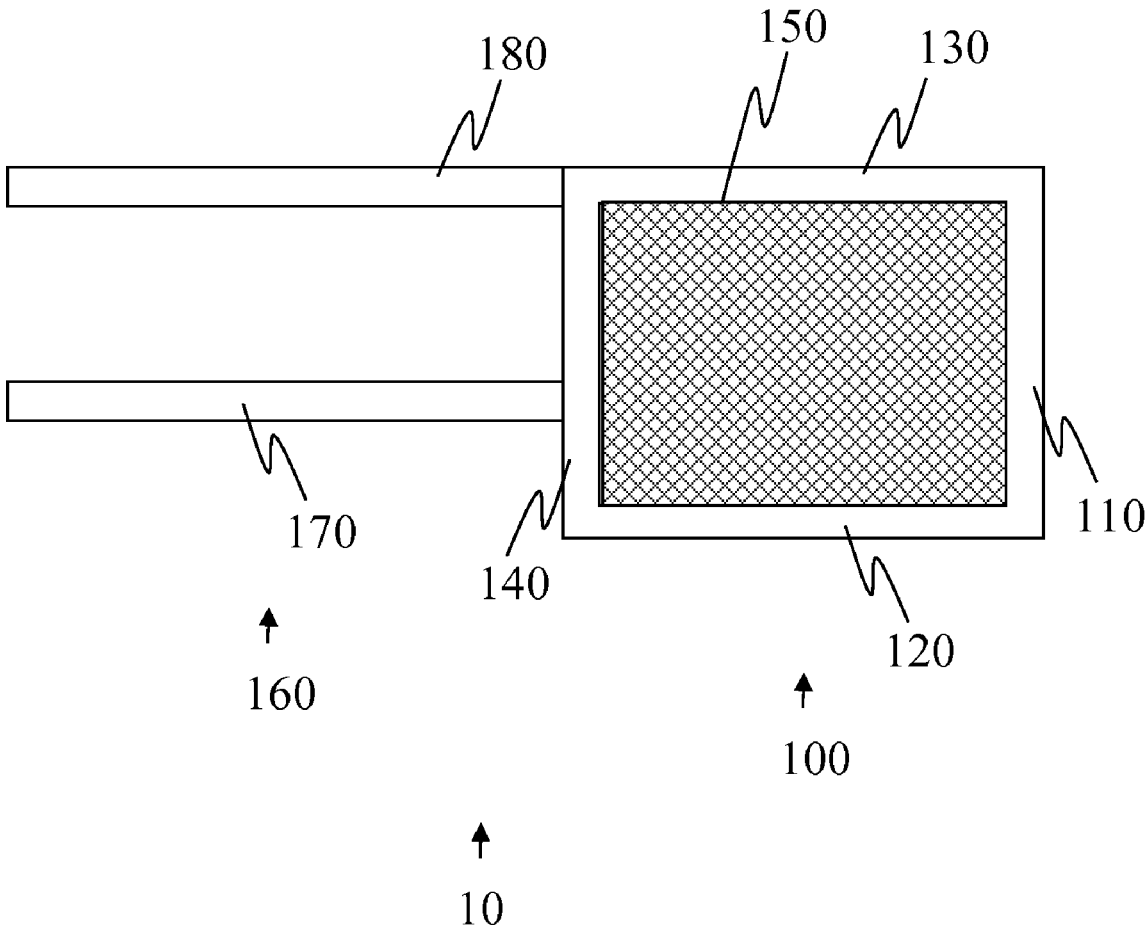
FIG. 3 is a top view of one embodiment of a tree ladder stand tray depicting one tray area according to the present invention.
Figure 5:
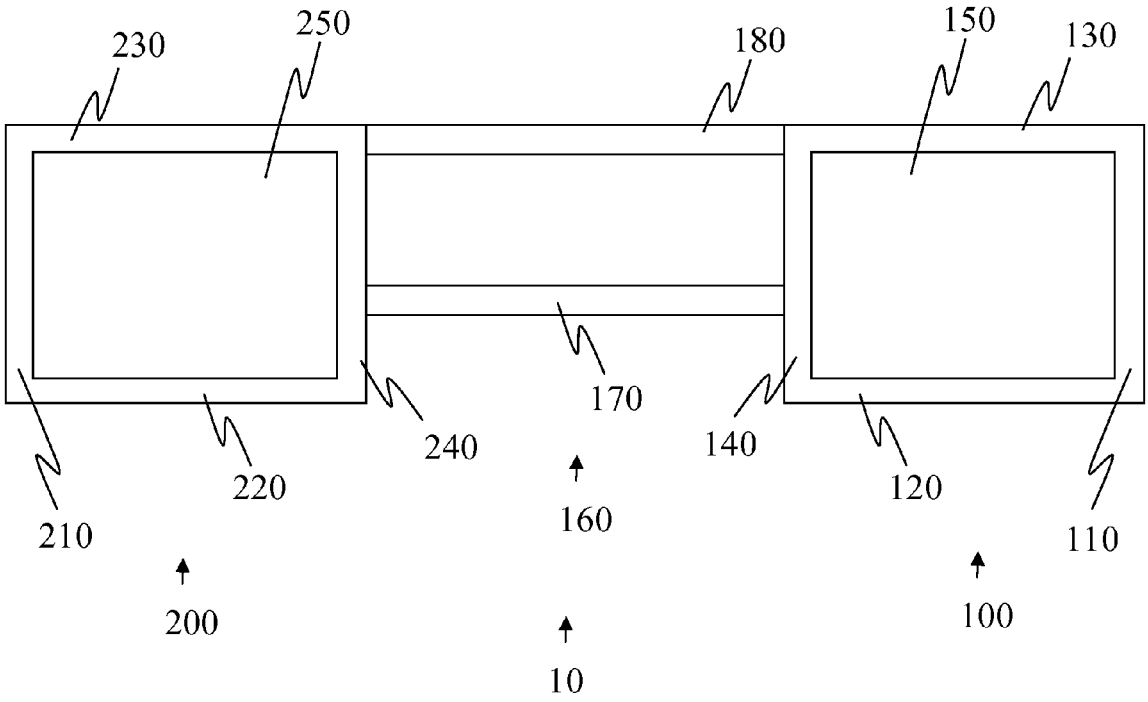
FIG. 5 is a top view of another embodiment of a tree ladder stand tray illustrating a first and second tray area for attaching the first and second tray areas on opposite sides of a tree ladder stand according to the present invention.

Overview:

Referring to the drawings, FIG. 1 depicts a tree ladder stand tray 10 that may be combined with a tree ladder stand 102. The tree ladder stand tray 100 may include a single tray area 100 or multiple tray areas 100, 200 on opposite sides of the tree ladder stand 102. The tray area 100 includes a tray end support 110, a tray forward support 120, a tray rear support 130, a tray mid support 140, and a tray bottom 150. The tray end support 110 is attached with the tray forward support 120 and the tray rear support 130, the tray mid support 140 is attached with the tray forward support 120 and the tray rear support 130, and the tray bottom 150 is attached within the area formed by the tray end support 110, the tray forward support 120, the tray rear support 130, and the tray mid support 140. The supports 110, 120, 130, 140 together form an edge that extends above the tray bottom 150 to help prevent articles from falling off the tray area 100. In addition to the tray area 100, the tree ladder stand tray 10 includes a bracket 160, as shown in FIGS. 3 and 5, with a forward brace 170 attached to the tray area 100 and a rear brace 180 attached to the tray area 100 such that the tray area 100 may be attached with a tree ladder stand 102. Due to the design of many tree ladder stands 102, the area under the tree ladder stand seat 104 may be limited and the distance between the forward brace 170 and the rear brace 180 is such that the bracket 160 will fit under a tree ladder stand seat 104 and provide attachment of the tree ladder stand tray 10 with a tree ladder stand 102.

Figure 4:
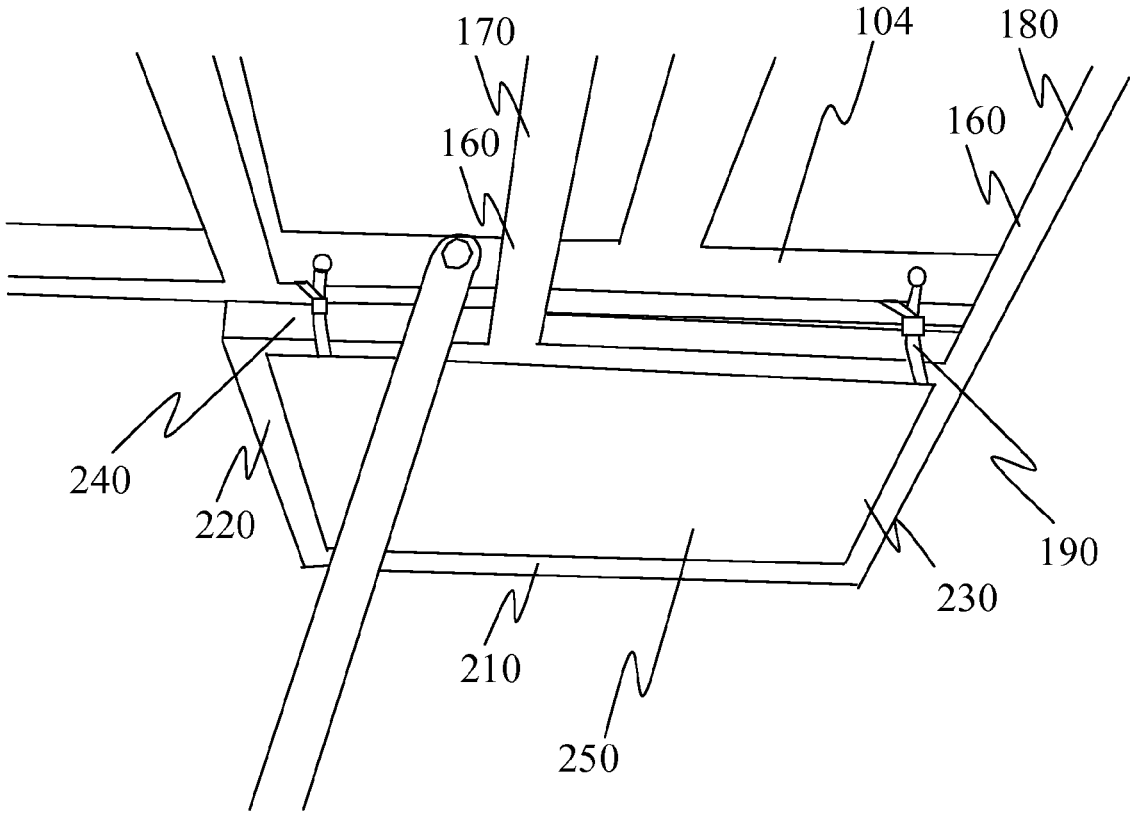
FIG. 4 is a partial perspective view of one embodiment of a tree ladder stand tray with a tree ladder stand depicting one attachment under a tree ladder stand seat according to the present invention.

Design Specifications:

As depicted in different embodiments in FIGS. 1 through 5, a tree ladder stand tray 10 includes at least one tray area 100 and a bracket 160. The tray area 100 includes a tray end support 110, a tray forward support 120, a tray rear support 130, a tray mid support 140, and a tray bottom 150. The tray end support 110 is attached with the tray forward support 120 and the tray rear support 130, the tray mid support 140 is attached with the tray forward support 120 and the tray rear support 130, and the tray bottom 150 is attached within the area formed by the tray end support 110, the tray forward support 120, the tray rear support 130, and the tray mid support 140. The supports 110, 120, 130, 140 together form an edge that is inclined above the tray bottom 150 to help prevent articles from falling off the tray area 100. The tree ladder stand tray 10 may include a second tray area 200. The second tray area 200 includes a second tray end support 210, a second tray forward support 220, a second tray rear support 230, a second tray mid support 240, and a second tray bottom 250. In addition, the second tray end support 210 is attached with the second tray forward support 220 and the second tray rear support 230, the second tray mid support 240 is attached with the second tray forward support 220 and the second tray rear support 230, and the second tray bottom 250 is attached within the area of the second tray end support 210, the second tray forward support 220, the second tray rear support 230, and the second tray mid support 240 such that the second supports 210, 220, 230, 240 form a second edge to help prevent articles from falling of the second tray area 200. In one preferred embodiment, the overall dimension of the tray area may be fourteen inches wide and fifteen inches from front to rear. The tray supports 110, 120, 130, 140, 210, 220, 230, 240 may be metal tubing, plastic tubing, metal angle, plastic angle, or wood strips. Preferred tray supports may be three-quarters inch tubing. The tray bottom 150, 250 may be metal grating, plastic grating, plastic netting, rope netting, metal sheet, plastic sheet, or wood. The tree ladder stand tray 10 includes a bracket 160, as shown in FIGS. 1 through 5, with a forward brace 170 attached to the tray area 100 and a rear brace 180 attached to the tray area 100 such that the tray area 100 may be attached with a tree ladder stand 102. Due to the design of many tree ladder stands 102, the area under the tree ladder stand seat 104 may be limited and the distance between the forward brace 170 and the rear brace 180 must be such that the bracket 160 will fit under a tree ladder stand seat 104. A second tray area 200 may be attached with the bracket 160 such that the second tray area 200 opposes the first tray area 100 wherein the bracket 160 including the forward brace 170 and the rear brace 180 will fit under the tree ladder stand seat 104 and provide attachment of the tray area 100 with the first and second tray area 100, 200 on each side of the tree ladder stand seat 104. In one embodiment, the tree ladder stand tray 10 may be manufactured with a stamping process wherein the shape and structure of the tree ladder stand tray 10 is stamped or formed from metal into an at least one piece embodiment with the structure and shape described. In another embodiment, the tree ladder stand tray 10 may be manufactured with an injection molding process wherein the shape and structure of the tree ladder stand tray 10 is plastic injected into a mold wherein the at least one piece embodiment is the structure and shape described. A preferred embodiment may include a bracket 160 wherein the dimension from the front of the forward brace 170 to the rear of the rear brace 180 is ten and one-quarter inches. In addition, a preferred embodiment may include a bracket 160 wherein the width dimension of the bracket 160 may be twenty inches from the first tray mid support 140 to the second mid support 240. In another embodiment, the width dimension of the bracket 160 may be twenty inches from the tray mid support 140 to the end of the forward and rear brace 170, 180. In one embodiment the overall width of a tree ladder stand tray 10 may be forty-eight inches from the first tray end support 110 to the second tray end support 210 wherein two tray areas 100, 200 are used with one tray area on each side of the tree ladder stand 102. In addition, in one embodiment the bracket 160 may provide a means of attachment of the tree ladder stand tray 10 with a tree ladder stand 102. In another embodiment, as illustrated in FIG. 4, the tray mid support 140 and/or the second tray mid support 240 may provide a means of attachment of the tree ladder stand tray 10 with a tree ladder stand seat 104. The tree ladder stand tray 10 may be attached with the tree ladder stand seat 104 by a means of attachment that includes but is not limited to wire ties 190 which hold the bracket 160 to the tree ladder stand seat 104, hardware fasteners such as nuts and bolts with washers, and pins with clips. The tree ladder stand tray 10 may be designed in combination with the tree ladder stand 102 or separately.

Figure 2:
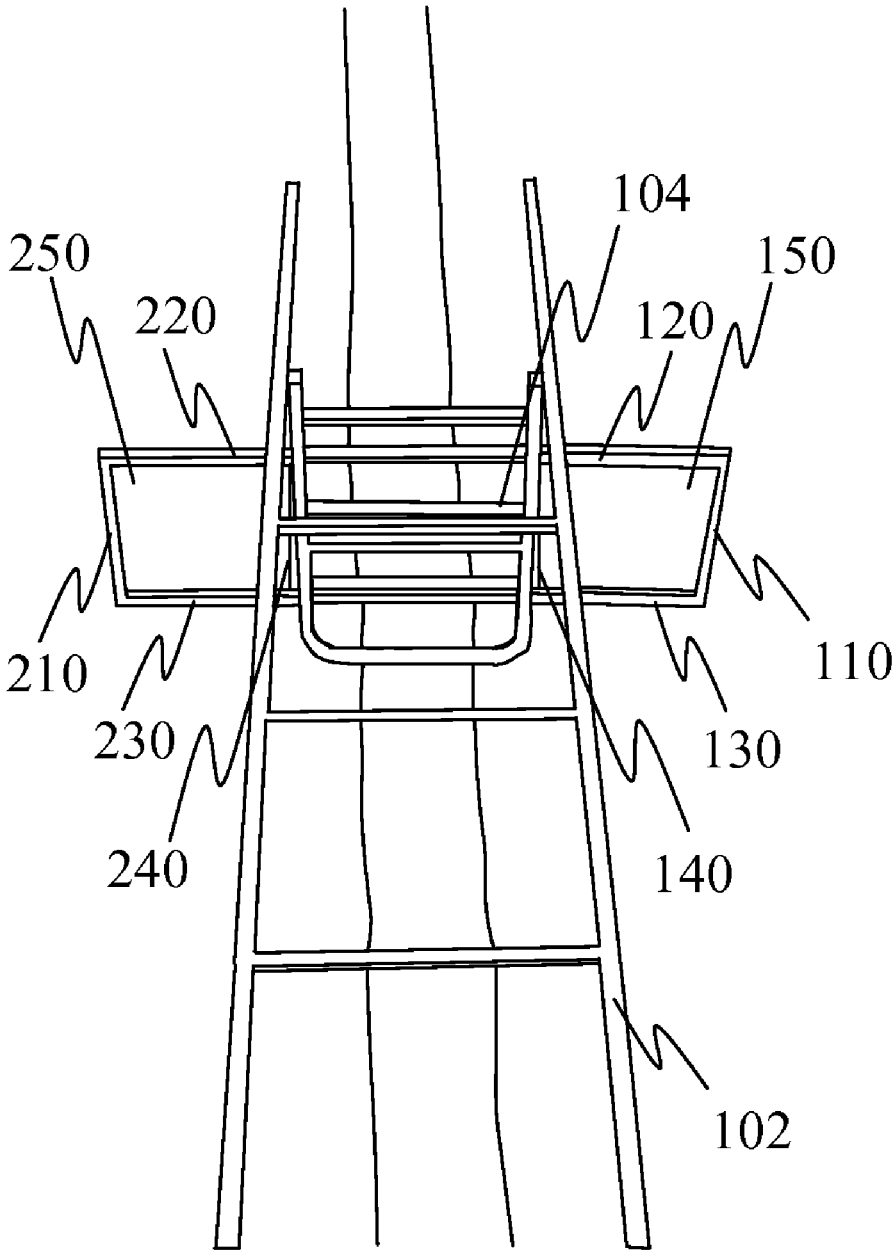
FIG. 2 is a perspective view of one embodiment of the tree ladder stand tray combined with a tree ladder stand according to the present invention.

Manner of Use:

A method of assembling and using a tree ladder stand tray 10 is illustrated in FIGS. 1, 2, and 4 comprising the steps of: placing the tree ladder stand tray 10 under the tree ladder stand seat 104, locating a hole for wire tie 190 attachment of the tree ladder stand tray 10, drilling a hole in the tree ladder stand seat 104 for the wire tie 190 attachment, using a wire tie 190 to attach the tree ladder stand tray 10 to the tree ladder stand seat 104, placing the tree ladder stand 102 vertical by the desired tree or post, climbing the tree ladder stand rungs 108 to the tree ladder stand foot area 106, placing articles on the tree ladder stand tray 10 as desired, and sitting on the tree ladder stand seat 104 as desired.

What is claimed is:

1. A tree ladder stand tray comprising:

a tray area including:

a tray end support, a tray forward support, a tray rear support, a tray mid support, and a tray bottom, wherein the tray end support is attached with the tray forward support and the tray rear support, the tray mid support is attached with the tray forward support and the tray rear support, and the tray bottom is attached within the area of the tray end support, the tray forward support, the tray rear support, and the tray mid support such that the supports form an edge to help prevent articles from falling off the tray area; and a bracket including a means for removably attaching the bracket with a tree ladder stand and a forward brace attached to the tray area and a rear brace attached to the tray area such that the tree ladder stand tray is attached with the tree ladder stand, whereby the distance between the forward brace and the rear brace is such that the bracket will fit under a tree ladder stand seat and may provide removable attachment of the tree ladder stand tray with the tree ladder stand.

2. The tree ladder stand tray according to claim 1 further comprising a second tray area including:

a second tray end support, a second tray forward support, a second tray rear support, a second tray mid support, and a second tray bottom, wherein the second tray end support is attached with the second tray forward support and the second tray rear support, the second tray mid support is attached with the second tray forward support and the second tray rear support, and the second tray bottom is attached within the area of the second tray end support, the second tray forward support, the second tray rear support, and the second tray mid support such that the second supports form a second edge to help prevent articles from falling off the second tray area;

wherein the second tray area is attached with the bracket such that the second tray area opposes the first tray area wherein the bracket including the forward brace and the rear brace will fit under the tree ladder stand seat and provide removable attachment of the tray area with the first and second tray area on each side of the tree ladder stand seat.

3. The tree ladder stand tray according to claim 2 in combination with the tree ladder stand wherein the tree ladder stand tray is removably attached with the tree ladder stand.

4. The tree ladder stand tray according to claim 2 wherein the tree ladder stand tray bracket is twenty inches wide, and ten and one quarter inches from the front of the forward brace to the rear of the rear brace such that the bracket may fit within the area under the tree ladder stand seat.

5. The tree ladder stand tray according to claim 2 wherein the means for attaching the bracket with the tree ladder stand is wire ties.

6. The tree ladder stand tray according to claim 2 wherein the means for attaching the bracket with the tree ladder stand is hardware fasteners.

7. The tree ladder stand tray according to claim 2 wherein the tree ladder stand tray supports and braces may be selected from a list consisting of metal tubing, plastic tubing, metal angle, plastic angle, and wood strips.

8. The tree ladder stand tray according to claim 2 wherein the tray bottom may be selected from a list consisting of metal grating, plastic grating, plastic netting, rope netting, metal sheet, plastic sheet, and wood.

9. The tree ladder stand tray according to claim 2 wherein the tree ladder stand tray bracket is twenty inches wide, and ten and one quarter inches from the front of the forward brace to the rear of the rear brace such that the bracket may fit within the area under many tree ladder stand seats; and wherein the overall width of the tree ladder stand tray is approximately forty-eight inches and the first tray area is approximately fifteen inches from the front of the first tray forward support to the rear of the first tray rear support by fourteen inches wide and the second tray area is approximately fifteen inches from the front of the second tray forward support to the rear of the second tray rear support by fourteen inches wide such that there is an approximate five inch cutout in front of the forward brace between the first tray mid support and the second tray mid support.

* * * * *